US005893519A

United States Patent [19]

Cavaretta et al.

[11] Patent Number: 5,893,519

[45] Date of Patent: Apr. 13, 1999

[54] SELF-EDUCTING, HIGH EXPANSION, MULTI-AGENT NOZZLE

[76] Inventors: Kenneth L. Cavaretta, 4400 Kandywood, Port Arthur, Tex. 77642; Richard R. Bigelow, P.O. Box 434, Bridge City, Tex. 77611

[21] Appl. No.: 08/928,599

[22] Filed: Sep. 12, 1997

[51] Int. Cl.[6] ..... B05B 7/30

[52] U.S. Cl. ..... 239/318; 239/427; 239/428; 239/398

[58] Field of Search ..... 239/398, 427, 239/428, 318, 506, 505, 499

[56] References Cited

U.S. PATENT DOCUMENTS

| | | | |
|---|---|---|---|
| 862,939 | 8/1907 | Richardson | 239/318 |
| 2,690,717 | 10/1954 | Goodrie | 239/318 |
| 3,405,872 | 10/1968 | Stuart, Sr. | 239/318 |
| 3,504,702 | 4/1970 | Collins et al. | 239/318 |
| 3,756,457 | 9/1973 | Holmes et al. | 222/1 |
| 4,193,550 | 3/1980 | Juttelstad et al. | 239/314 |
| 4,623,095 | 11/1986 | Pronk | 239/311 |
| 4,673,006 | 6/1987 | Speck | 141/1 |
| 4,705,405 | 11/1987 | Williams | 366/160 |
| 4,781,467 | 11/1988 | Williams | 366/150 |
| 4,901,765 | 2/1990 | Poe | 137/893 |
| 5,305,476 | 4/1994 | Ohyama et al. | 4/605 |

*Primary Examiner*—Andres Kashnikow
*Assistant Examiner*—David Deal
*Attorney, Agent, or Firm*—Matthews, Joseph, Shaddox & Mason, P.L.L.C.; Henry L. Ehrlich

[57] ABSTRACT

A self-educting, high expansion, multi-agent nozzle of the type for educting more than one chemical and mixing these chemicals with a motive fluid stream within the nozzle and ejecting the mixed fluid stream is provided. The self-educting, high expansion, multi-agent nozzle including a body having an eductor section and a barrel section, the eductor section forming a vacuum chamber and a first and second chemical port adapted for connecting to a first and second chemical source respectively, the barrel section forming a pathway between an inlet from the eductor section to an open discharge end; a head forming a tapered conduit between an open motive fluid end adapted for connecting to a motive fluid source and an open exit end, the head connected to an open head end of the eductor section in a manner such that the exit end is disposed within the vacuum chamber; a barrel sleeve movably connected to an exterior surface of the barrel section; and a diffuser mounted within the pathway of the barrel section.

20 Claims, 2 Drawing Sheets

SELF-EDUCTING, HIGH EXPANSION, MULTI-AGENT NOZZLE

TECHNICAL FIELD

The present invention relates to educting nozzles for fire fighting, cooling or vapor mitigation and more particularly to a self-educting, high expansion, multi-agent nozzle that may internally mix at least two chemicals with a motive fluid and eject the mixed fluid.

BACKGROUND ART

Nozzles are commonly used in connection with a motive fluid, such as water, to convert the stream from the motive fluid source into a stream or fog pattern to directly fight a fire, cool adjacent structures, cool individuals in high heat situations, and for mitigation of released toxic vapors. At times this quenching stream of ejected fluid is water focused through a nozzle which merely converts a pressure head, from the motive fluid source, to a velocity head so as to eject the fluid a distance away from the operator. Often it is desirable to aspirate the motive fluid stream and/or mix chemicals with the stream to create a foam to further aid in quenching a fire or mitigating fume emissions.

In the petroleum, petro-chemical, shipping industry, and other refining and manufacturing operations, in particular, it is necessary to have fire fighting equipment on hand and ready for immediate use. For these toxic type fires and/or spills it is common to mix chemicals with a motive fluid such as water. The resulting mixture is then ejected to quench the fire and/or mitigate the emission of toxic vapors. It is common in these situations for the mixture to be ejected as a foam or other mixed agent.

One agent commonly used is formed by mixing AFFF and PURPLE K powder with water to combat special type hazards. These special type mixes are especially effective in containing the emission of toxic fumes and quenching fires. However, one of the problems in forming and ejecting these agents is that the chemicals and a motive fluid, such as water, must be mixed just prior to ejection from a nozzle before the mixture becomes too viscous to eject in an effective manner. Another problem with prior nozzles is that the chemicals are not thoroughly mixed with the motive fluid thereby decreasing the effectiveness of the resulting mixture. In addition, with many of these prior art nozzles dry or solid chemicals are mixed at the ejection point of the nozzle resulting in the drop out of much of the chemical added. Further, the prior art nozzles have a tendency to clog when solid chemicals or debris enter the eduction device.

It would be a benefit, therefore, to have a nozzle which is capable of educting more than one chemical and mixing the chemicals in the motive fluid stream. It would be a further benefit to have a self-educting nozzle which educts and mixes the chemicals upstream of the nozzle outlet thereby effecting better mixing, expansion and reduction of drop out of the chemicals. It would be a still further benefit to have a self-educting nozzle which has no internal small bore diameter eductors or support type obstacles and parts thereby reducing clogging of the nozzle and increasing the range and effectiveness of the ejected stream.

GENERAL SUMMARY DISCUSSION OF INVENTION

It is thus an object of the invention to provide a self-educting, high expansion, multi-agent nozzle that is capable of educting more than one chemical and mixing the chemicals with the motive fluid within the nozzle.

It is a further object of the invention to provide a self-educting, high expansion, multi-agent nozzle that has no internal small bore diameter parts diverting a portion of the motive fluid thereby reducing head loss and increasing the range of the ejected stream.

It is a still further object of the invention to provide a self-educting, high expansion, multi-agent nozzle that may educt more than one chemical with less possiblility of clogging and thoroughly mix the agents with a motive fluid at the rear of the nozzle as opposed to the nozzle exit and ejecting the mixed fluid stream without clogging.

It is a still further object of the invention to provide a self-educting, high expansion, multi-agent nozzle that is capable of educting and mixing more than one chemical with a motive stream upstream of the nozzle discharge end thereby effecting thorough mixing and reducing drop out of the added chemicals.

Accordingly, a self-educting, high expansion, multi-agent nozzle of the type for educting more than one chemical and mixing these chemicals with a motive fluid stream within the nozzle and ejecting the mixed fluid stream is provided. The self-educting, high expansion, multi-agent nozzle includes a body having an eductor section and a barrel section, the eductor section forming a vacuum chamber and a first and second chemical port adapted for connecting to a first and second chemical source respectively, the barrel section forming a pathway between an inlet from the eductor section to an open discharge end; a head forming a tapered conduit between an open motive fluid end adapted for connecting to a motive fluid source and an open exit end, the head connected to an open head end of the eductor section in a manner such that the exit end is disposed within the vacuum chamber; a barrel sleeve movably connected to an exterior surface of the barrel section; and a diffuser mounted within the pathway of the barrel section. The nozzle may be manufactured with materials such as aluminum, stainless steel, brass and high density plastics, among other materials commonly found in the manufacture of fire fighting equipment. The body preferably includes an eductor section which forms a circular internal chamber or vacuum chamber. Formed through the walls of the eductor section are at least a first and second chemical port adapted for connecting to chemical sources for educting chemicals into the vacuum chamber and mixing the chemicals with a motive fluid stream. Extending from one end of this eductor section is a barrel section which forms a pathway from an inlet into the pathway from the vacuum chamber to an open discharge end where the mixed fluid stream is ejected. A motive fluid, such as pressurized water, is injected into the body of the nozzle through a head which is connected to the open head end of the eductor section, opposite the inlet to the barrel section. The head forms a tapered conduit extending from a motive fluid inlet to an open exit end of the head. The head is connected to the eductor section so that the open exit end is disposed within the vacuum chamber. In addition, a diffuser is mounted within the pathway of the barrel section to provide back pressure for the motive fluid stream and compression of the motive fluid within the tapered conduit. For adjusting the pattern of the mixed fluid stream which is ejected is a barrel sleeve which is movably connected to the exterior surface of the barrel.

The first and second chemical ports may be located approximately 180 degrees from one another to aide in the eduction and mixing of chemicals having different physical properties. However, the ports may be spaced in other configurations. Preferably, the first and second chemical ports are positioned upstream of the exit end of the tapered conduit. Upstream being defined from the motive fluid source and downstream to the discharge end of the barrel section.

Preferably the barrel sleeve is moveably connected to the barrel section so as to be moveable from a full fog position to a full stream position. The barrel sleeve may be slidably connected to the barrel and preferably have a locking mechanism to maintain the sleeve in a desired position. The barrel sleeve may be rotatably connected to the barrel, such as by threading. The barrel sleeve may be connected to a motor for mechanically adjusting the position of the sleeve preferably from a remote site by an operator.

The nozzle of the present invention may have a diffuser mounted within the pathway of the barrel section. Typically, the diffuser will be mounted in a set position, however, the diffuser may be movably mounted with the barrel. The diffuser may be moveable to a position exterior of the open discharge end of the barrel section. The moveable diffuser provides a mechanism, especially in conjunction with the moveable barrel sleeve, to control and manipulate the pattern and the flow rate of the ejected fluid stream.

It may also be desired to mount a stream straightener within the pathway to reduce the turbulence of the mixed fluid stream as it passes through the pathway. This reduction in turbulence helps to reduce the head loss of the mixed fluid as it passes through the pathway.

The nozzle may further include a mechanism for introducing air into the vacuum chamber thereby aspirating the motive fluid as it passes through the nozzle. This aspirating mechanism may include a port through the wall of the eductor section into the vacuum section and a valve connected to the port to control the amount of air mixed with the motive fluid stream. The aspiration mechanism is especially beneficial when the motive fluid is mixed with a chemical prior to entering the nozzle and intended to be ejected as foam.

In a preferred embodiment, the exit port is positioned substantially adjacent to the inlet to the pathway. In this manner, a more pronounced low pressure zone or vacuum zone is formed in the vacuum chamber thereby making eduction of the chemicals and mixture with the motive fluid stream more effective.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
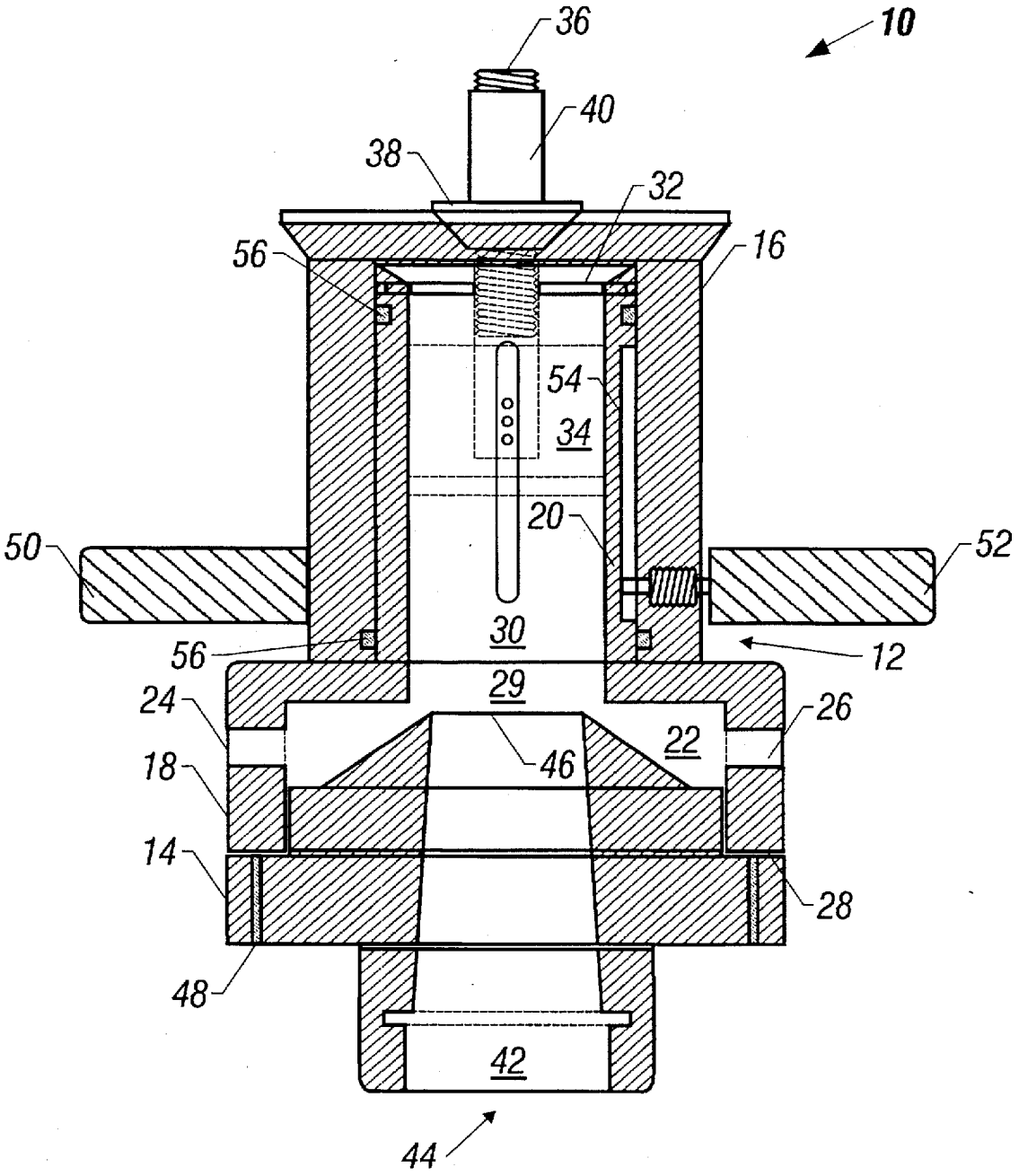
FIG. 1 is a cross-sectional, top view of the self-educting, high expansion, multi-agent nozzle of the present invention.

FIG. 1 is a cross-sectional, top view of the self-educting, high expansion, multi-agent nozzle of the present invention designated generally by the numeral 10. Nozzle 10 includes a body 12, a head 14 and a barrel sleeve 16.

As shown in FIG. 1, body 12 is constructed of stainless steel and has an eductor section 18 and a barrel section 20. Eductor section 18 forms a 360 degree internal vacuum chamber 22. A first chemical port 24 and a second chemical port 26 are formed through the wall of eductor section 18 and are adapted for connecting chemical sources to nozzle 10. In this embodiment, first and second chemical ports 24,26 are positioned 180 degrees from each other. Eductor section 18 further includes a head end 28 for connecting head 14 thereto.

Barrel section 20 extends outwardly from the opposite end of eductor section 18 from that of head end 28. Barrel 20 is an elongated member forming a pathway 30 from vacuum chamber 22 to an open discharge end 32 of barrel 20. Connected within pathway 30 is a stream straightener 34 for reducing the turbulence of the mixed motive fluid stream. In this embodiment, stream straightener 34 is a blade extending laterally across a portion of pathway 30.

A diffuser stem 36 is connected within pathway 30 of barrel 20 and substantially centered therein. Stem 36 is threaded for movably connecting a diffuser 38 thereon and, as shown, is maintained in a set position by a lock nut 40.

Head 14 forms a tapered conduit 42 in fluid communication between an open motive fluid end 44 and an open exit end 46. Although not shown in the figure, motive fluid end 44 is adapted for connecting to a source of motive fluid, such as water. Motive fluid end 44 may be threadably connected, welded, flanged or connected directly to a motive fluid source, such as a pipe line. Motive fluid end 44 may be connected to a motive fluid source via a monitor, to provide a reservoir of water.

In this embodiment, head 14 is connected to head end 28 by allen screws 48. Exit end 46 of head 14 is disposed within vacuum chamber 22 approximate the inlet 29 to barrel section 20. Head 14 is constructed, and attached to eductor section 18 so that exit end 46 is positioned downstream of first and second chemical ports 24,26. In this manner, as the motive fluid flows in and through conduit 42 it is compressed and ejected through exit end 46 reducing the pressure and/or creating a vacuum in vacuum chamber 22, thereby drawing chemicals into chamber 22 through chemical ports 24,26. As the chemicals are drawn in they are swirled around the 360 degree circumference of chamber 22 and mixed with the motive fluid as it enters pathway 30 to form a mixed fluid stream. This mixing of chemicals with the motive stream within vacuum chamber 22 provides a more thorough mixing and aspiration of the chemicals, especially solid chemicals, with reduced drop out of the chemicals as compared to the prior art nozzles.

Barrel sleeve 16 is a cylindrical member movably connected to barrel section 20. By moving barrel sleeve 16 along the length of barrel 20 the ejected fluid pattern may be adjusted from a full stream to a fog pattern. In the preferred embodiment, a first handle 50 and a second handle 52 are connected to sleeve 16 to aide a user in adjusting the position of sleeve 16 and nozzle 10. Second handle 52 is threadably connected and passes through sleeve 16 so as to secure sleeve 16 to barrel 20 in a desired position. Second handle 52 is aligned with a groove 54 formed along the outer surface of barrel 20 to provide a guide when moving sleeve 16. To further aide the movement of sleeve 16 along the length of barrel 20 is a pair of packing rings 56 connected between sleeve 16 and barrel 20. In the preferred embodiment packing rings 56 are formed of graphite.

Figure 2:
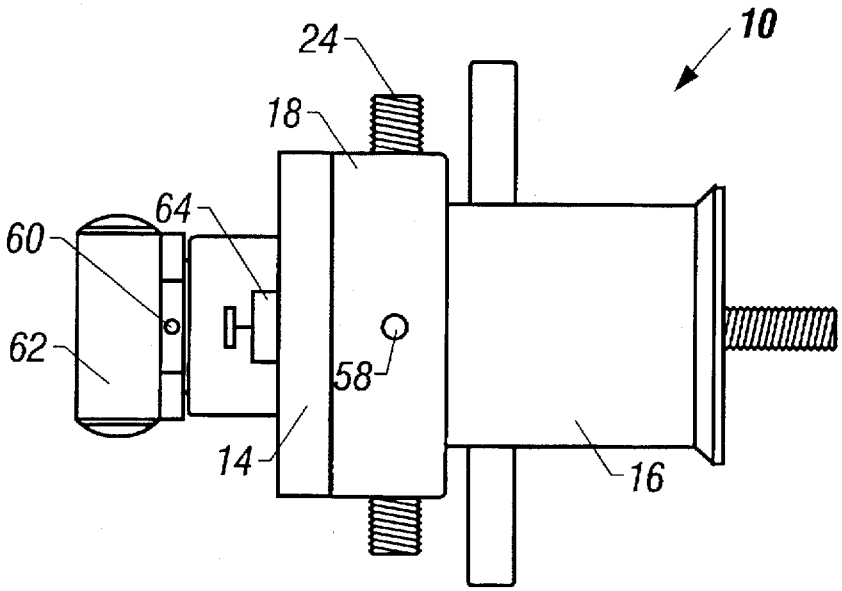
FIG. 2 is a top, plan view of the nozzle.

FIG. 2 is a top, plan view of nozzle 10 of the present invention. In this view, barrel sleeve 16 is positioned along barrel section 20 (FIG. 1) up against eductor section 18 so that the ejected fluid stream will be in a fog pattern.

As shown in FIG. 2, eductor section 18 has a vacuum gauge port 58 for connecting a gauge (not shown). In addition, a nozzle gauge port 60 is formed at the upstream end of head 14 where the motive fluid source 62 is connected to head 14.

It is often desirable, if not necessary, to aspirate the fluid stream, especially when the mixed fluid is to form a foam. As such, nozzle 10 includes an aspiration mechanism 64. Aspiration mechanism 64 provides a means of introducing air into vacuum chamber 22 (FIG. 1). As shown in FIG. 2, aspiration mechanism 64 is a needle valve in fluid communication between vacuum chamber 22 (FIG. 1) and the atmosphere. However, other valves or methods of introducing air into the fluid stream may be provided.

Figure 3:
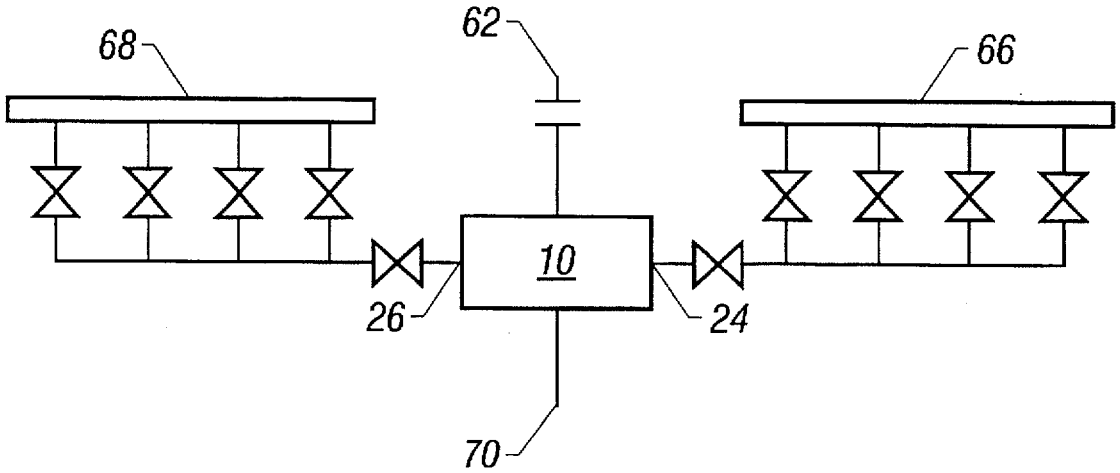
FIG. 3 is a schematic drawing of the self-educting nozzle of the present invention.

FIG. 3 is a schematic drawing of self educting nozzle 10 of the present invention. In this embodiment a plurality of chemicals are connected via a first manifold 66 to first chemical port 24 for educting a single or combination of chemicals into nozzle 10. Another source of chemicals are connected via a second manifold 68 to second chemical port 26 for educting a single or combination of chemicals into nozzle 10. The chemicals educted into nozzle 10 are mixed with the motive fluid 62 and educted as a mixed fluid stream 70.

Use of self-educting, high expansion, multi-agent nozzle 10 is describe herein with reference to FIGS. 1 through 3. A motive fluid 62, such as water, is connected under pressure to motive end 44 of head 14. As motive fluid 62 passes through tapered conduit 42 the air entrained within fluid 62 is compressed and the velocity of fluid 62 is increased. As fluid 62 passes through exit end 46 of head 14 the air entrained in fluid stream 62 rapidly expands causing a great amount of turbulence and creating a vacuum in vacuum chamber 22, educting chemicals through chemical ports 24,26 into chamber 22. The educted chemicals swirl around vacuum chamber 22 and are mixed with fluid stream 62 as it passes into pathway 30 of body 12. As mixed fluid stream 70 passes through pathway 30 it passes by stream straightener 34 reducing the turbulence in stream 70 and is ejected through discharge end 32. Ejected mixed fluid stream 70 may be adjusted from a full fog position in which barrel sleeve 16 is position towards eductor section 18 of body 12 to a full stream position wherein barrel sleeve 16 is positioned outwardly from eductor section 18 along barrel section 20. The flow rate of ejected mixed fluid stream 70 may also be adjusted by moving diffuser 38 along stem 36.

In some applications a foaming agent may be injected into motive fluid 62 upstream of nozzle 10. For these applications aspiration mechanism 64 is provided so that air may be introduced into vacuum chamber 22. In this embodiment aspiration mechanism 64 includes a port (not shown) formed through head 14 and in fluid communication between vacuum chamber 22 and the atmosphere. Connected to the port to meter the amount of air introduced to chamber 22 is mechanism 64 which in this embodiment is a needle valve, although it may be any type valve which allows the introduction of air to be controlled.

In one experimental testing of nozzle 10 with barrel sleeve 16 in the full stream position, a stream was ejected 160 feet with 40 psig measured at nozzle gauge port 60 and 15 inches Hg observed at vacuum gauge port 58.

In another experimental testing with sleeve 16 in the full fog position a 35 degree pattern was ejected 56 feet with 100 psig at nozzle gauge port 60 and 30 inches Hg, theoretical, observed at vacuum gauge port 58.

In another experimental testing of nozzle 10 over twenty pounds of bird seed, including sunflower seeds, was educted through a chemical port 26 and mixed in the stream and ejected without clogging of vacuum chamber 22 or any other section of nozzle 10. The diameters of the seeds varied up to at least 0.25 inches.

It can be seen from the preceding description that a method and device for internally educting and mixing at least two chemicals with a motive fluid and ejecting the mixed fluid which has no internal moving parts and or reduced bore diameter reducing head loss and increasing the range of the ejected stream, that may educt more than one chemical and mix them with a motive fluid within the nozzle and ejecting the mixed fluid stream without clogging, and that is capable of educting and mixing more than one chemical with a motive stream upstream of the nozzle discharge end thereby effecting thorough mixing and reducing drop out of the added chemicals has been provided.

It is noted that the embodiment of the self-educting, high expansion, multi-agent nozzle described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A self-educting, high expansion, multi-agent nozzle comprising:

a body having an eductor section and a barrel section, said eductor section forming a vacuum chamber and a first and second chemical port adapted for connecting to a first and second chemical source respectively, said barrel section forming a pathway between an inlet from said eductor section to an open discharge end;

a head forming a tapered conduit between an open motive fluid end adapted for connecting to a motive fluid source and an open exit end, said head connected to an open head end of said eductor section in a manner such that said exit end is disposed within said vacuum chamber;

a barrel sleeve movably connected to an exterior surface of said barrel section; and a diffuser mounted within said pathway of said barrel section.

2. The self-educting, high expansion, multi-agent nozzle of claim 1, wherein:

said first and said second chemical ports are formed through said eductor section into said vacuum chamber spaced 180 degrees apart.

3. The self-educting, high expansion, multi-agent nozzle of claim 1, wherein:

said diffuser is movably mounted within said pathway of said barrel section.

4. The self-educting, high expansion, multi-agent nozzle of claim 3, further including:

a stream straightener mounted within said pathway of said barrel section.

5. The self-educting, high expansion, multi-agent nozzle of claim 3, further including:

an aspiration mechanism in fluid communication between the exterior atmosphere and said vacuum chamber in a manner such that air may be aspirated into said vacuum chamber.

6. The self-educting, high expansion, multi-agent nozzle of claim 1, further including:

a stream straightener mounted within said pathway of said barrel section.

7. The self-educting, high expansion, multi-agent nozzle of claim 6, further including:

an aspiration mechanism in fluid communication between the exterior atmosphere and said vacuum chamber in a manner such that air may be aspirated into said vacuum chamber.

8. The self-educting, high expansion, multi-agent nozzle of claim 6, wherein:

said exit end of said head is positioned within said vacuum chamber substantially adjacent said inlet to said pathway of said barrel section.

9. The self-educting, high expansion, multi-agent nozzle of claim 1, further including:

an aspiration mechanism in fluid communication between the exterior atmosphere and said vacuum chamber in a manner such that air may be aspirated into said vacuum chamber.

10. The self-educting, high expansion, multi-agent nozzle of claim 1, wherein:

said first and second chemical ports are positioned within said vacuum chamber upstream of the position of said exit end of said head within said vacuum chamber.

11. The self-educting, high expansion, multi-agent nozzle of claim 1, wherein:

said exit end of said head is positioned within said vacuum chamber substantially adjacent said inlet to said pathway of said barrel section.

12. A self-educting, high expansion, multi-agent nozzle comprising:

a body having an eductor section and a barrel section, said eductor section forming a vacuum chamber and a first and second chemical port adapted for connecting to a first and second chemical source respectively, said barrel section forming a pathway between an inlet from said eductor section to an open discharge end;

a head forming a tapered conduit between an open motive fluid end adapted for connecting to a motive fluid source and an open exit end, said head connected to an open head end of said eductor section in a manner such that said exit end is disposed within said vacuum chamber and downstream of said first and said second chemical ports;

a barrel sleeve movably connected to an exterior surface of said barrel section; and a diffuser mounted within said pathway of said barrel section.

13. The self-educting, high expansion, multi-agent nozzle of claim 12, wherein:

said exit end of said head is positioned within said vacuum chamber substantially adjacent said inlet to said pathway of said barrel section.

14. The self-educting, high expansion, multi-agent nozzle of claim 13, further including:

a stream straightener mounted within said pathway of said barrel section.

15. The self-educting, high expansion, multi-agent nozzle of claim 12, further including:

a stream straightener mounted within said pathway of said barrel section.

16. The self-educting, high expansion, multi-agent nozzle of claim 12, wherein:

said diffuser is movably mounted within said pathway of said barrel section.

17. The self-educting, high expansion, multi-agent nozzle of claim 16, further including:

a stream straightener mounted within said pathway of said barrel section.

18. The self-educting, high expansion, multi-agent nozzle of claim 12, wherein:

said first and said second chemical ports are formed through said eductor section into said vacuum chamber spaced 180 degrees apart.

19. The self-educting, high expansion, multi-agent nozzle of claim 18, further including:

a stream straightener mounted within said pathway of said barrel section.

20. A self-educting, high expansion, multi-agent nozzle comprising:

a body having an eductor section and a barrel section, said eductor section forming a vacuum chamber and a first and second chemical port adapted for connecting to a first and second chemical source respectively, said barrel section forming a pathway between an inlet from said eductor section to an open discharge end;

a head forming a tapered conduit between an open motive fluid end adapted for connecting to a motive fluid source and an open exit end, said head connected to an open head end of said eductor section in a manner such that said exit end is disposed within said vacuum chamber substantially adjacent said inlet from said vacuum chamber to said pathway and downstream of said first and said second chemical ports;

a barrel sleeve movably connected to an exterior surface of said barrel section; and a diffuser mounted within said pathway of said barrel section.

* * * * *